US008121835B2

(12) United States Patent
Archibald

(10) Patent No.: US 8,121,835 B2
(45) Date of Patent: Feb. 21, 2012

(54) AUTOMATIC LEVEL CONTROL OF SPEECH SIGNALS

(75) Inventor: Fitzgerald John Archibald, Kanyakumari district (IN)

(73) Assignee: Texas Instruments Incorporated, Dallas, TX (US)

( * ) Notice: Subject to any disclaimer, the term of this patent is extended or adjusted under 35 U.S.C. 154(b) by 785 days.

(21) Appl. No.: 12/043,151

(22) Filed: Mar. 6, 2008

(65) Prior Publication Data

US 2008/0235011 A1 Sep. 25, 2008

Related U.S. Application Data

(60) Provisional application No. 60/896,057, filed on Mar. 21, 2007.

(51) Int. Cl.
*G10L 19/14* (2006.01)

(52) U.S. Cl. ..... 704/225; 704/209; 704/210; 704/219; 704/221; 704/226; 704/229; 704/231; 704/236; 704/268

(58) Field of Classification Search ..... 704/209, 704/229, 210, 221
See application file for complete search history.

(56) References Cited

U.S. PATENT DOCUMENTS

| | | | | |
|---|---|---|---|---|
| 5,012,519 | A * | 4/1991 | Adlersberg et al. | 704/226 |
| 5,953,696 | A * | 9/1999 | Nishiguchi et al. | 704/209 |
| 6,029,134 | A * | 2/2000 | Nishiguchi et al. | 704/268 |
| 6,272,459 | B1 * | 8/2001 | Takahashi | 704/221 |
| 6,377,919 | B1 * | 4/2002 | Burnett et al. | 704/231 |
| 6,415,253 | B1 * | 7/2002 | Johnson | 704/210 |
| 7,013,269 | B1 * | 3/2006 | Bhaskar et al. | 704/219 |
| 2001/0044718 | A1 * | 11/2001 | Cox et al. | 704/236 |
| 2005/0065788 | A1 * | 3/2005 | Stachurski | 704/229 |

OTHER PUBLICATIONS

Kiam Heong Ang, Gregory Chong and Yun Li, PID control system analysis, design, and technology, IEEE Transactions on Control Systems Technology, Year Jul. 2005, pp. 559-576, vol. 13, No. 4.
George S. Kang and Mark L.Lidd, Automatic Gain Control, IEEE, Year 1984, pp. 19.6.1-19.6.4.
George R. Steber, Digital Signal Processing in Automatic Gain Control Systems, E L E C T R I C A L Engineering and Computer Science Department University of Wisconsin-Milwaukee Milwaukee, Wisconsin 53201, IECON, pp. 381-384.
William S. Levine, The Control Hand book, by CRC Press, Inc, Year 1996, pp. 198-209.

* cited by examiner

*Primary Examiner* — Richemond Dorvil
*Assistant Examiner* — Michael Colucci
(74) *Attorney, Agent, or Firm* — Robert D. Marshall, Jr.; W. James Brady; Frederick J. Telecky, Jr.

(57) ABSTRACT

Automatic level control of speech portions of an audio signal is provided. An audio signal is received in the form of a sequence of samples and may contain speech portion and non-speech portions. The sequence of samples is divided into a sequence of sub-frames. Multiple sub-frames adjacent to a present sub-frame are examined to determine a peak value of samples in the sub-frames. A gain factor is computed for the present sub-frame based on the peak value and a desired maximum value for said speech portion, and each sample in the present sub-frame is amplified by the gain factor. In an embodiment, variations in filtered energy values of multiple sub-frames enable determination of whether a sub-frame corresponds to a speech or non-speech/noise portion.

17 Claims, 4 Drawing Sheets

AUTOMATIC LEVEL CONTROL OF SPEECH SIGNALS

RELATED APPLICATION(S)

The present application claims priority from co-pending U.S. provisional application Ser. No. 60/896,057, entitled: "Method for Automatic Level Control of Speech Signal", filed on: 21 Mar. 2007, naming Texas Instruments Inc (the intended assignee) as Applicant and the same inventor (Archibald J Fitzgerald) as in the subject application as inventor, and is incorporated in its entirety herewith.

BACKGROUND

1. Field of the Technical Disclosure

The present disclosure relates generally to speech processing, and more specifically to techniques for automatic level control (ALC) of speech signals.

2. Related Art

Speech signals generally refer to signals representing speech (e.g., human utterances). Speech signals are processed using corresponding devices/components, etc. For example, a digital audio recording device or a digital camera may receive (for example, via a microphone) an analog signal representing speech, and generate digital samples representing the speech. The samples may be stored for future replay (by conversion to analog and providing the corresponding analog signal to a speaker), or may be replayed in real time, often after some processing.

There is often a need to perform level control of the speech signal. Level control refers to amplifying the speech signal by a desired degree ("gain factor") for each portion, with the desired degree often varying between portions. Automatic gain control refers to determining such specific degrees for corresponding portions without requiring human interference (for example, to specify the gain factor, or degree of amplification).

BRIEF DESCRIPTION OF THE DRAWINGS

The present invention will be described with reference to the following accompanying drawings, which are described briefly below.

In the drawings, like reference numbers generally indicate identical, functionally similar, and/or structurally similar elements. The drawing in which an element first appears is indicated by the leftmost digit(s) in the corresponding reference number.

DETAILED DESCRIPTION

Overview

An aspect of the present invention provides automatic level control of speech portions of an audio signal. In an embodiment, an audio signal is received in the form of a sequence of samples and may contain speech portion and non-speech portions. The sequence of samples is divided into a sequence of sub-frames. Multiple sub-frames adjacent to a present sub-frame are examined to determine a peak value of samples in the sub-frames. A gain factor is computed for the present sub-frame based on the peak value and a desired maximum value for said speech portion, and each sample in the present sub-frame is amplified by the gain factor. In an embodiment, variations in filtered energy values of multiple sub-frames enable determination of whether a sub-frame corresponds to a speech or non-speech/noise portion.

Several aspects of the invention are described below with reference to examples for illustration. It should be understood that numerous specific details, relationships, and methods are set forth to provide a full understanding of the invention. One skilled in the relevant art, however, will readily recognize that the invention can be practiced without one or more of the specific details, or with other methods, etc. In other instances, well known structures or operations are not shown in detail to avoid obscuring the features of the invention.

2. Example Device

Figure 1:
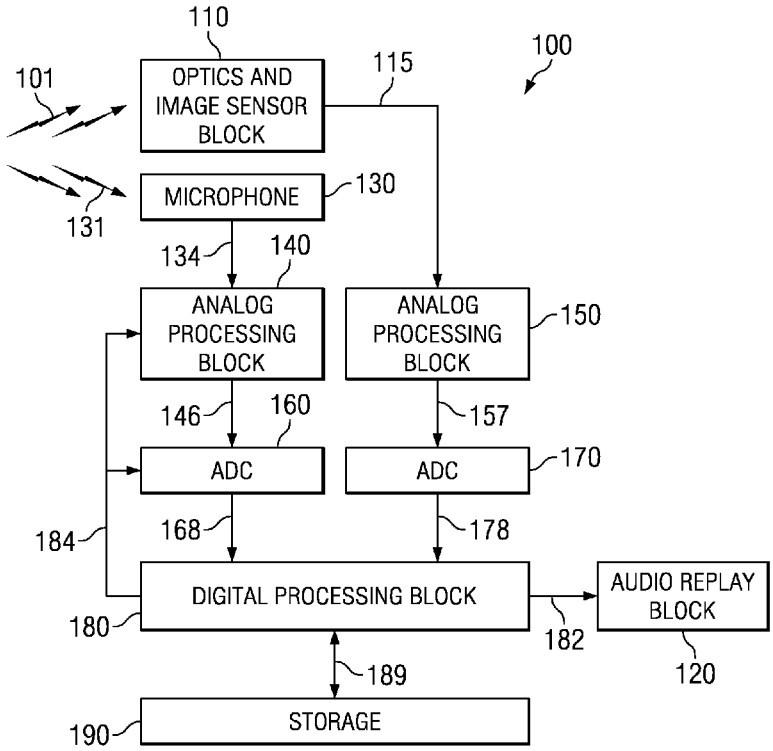
FIG. 1 is a block diagram of an example device in which several aspects of the present invention can be implemented.

FIG. 1 is a block diagram of an example device in which several aspects of the present invention can be implemented. Digital still camera 100 is shown containing optics and image sensor block 110, audio replay block 120, microphone 130, analog processing blocks 140 and 150, analog to digital converters (ADC) 160 and 170, digital processing block 180 and storage 190. Each block is described below in detail.

Optics and image sensor block 110 may contain lenses and corresponding controlling equipment to focus light beams 101 from a scene onto an image sensor such as a charge coupled device (CCD) or CMOS sensor. The image sensor contained within optics and image sensor block 110 generates electrical signals representing points on the image of scene 101, and forwards the electrical signals on path 115.

Analog processing block 150 performs various analog processing operations on the electrical signals received on path 115, such as filtering, amplification etc., and provides the processed image signals (in analog form) on path 157. ADC 170 samples the analog image signals on path 157 at corresponding time instances, and generates corresponding digital codes representing the strength (e.g., voltage) of the sampled signal instance. ADC 170 forwards the digital codes representing scene 101 on path 178.

Microphone 130 receives sound waves (131) and generates corresponding electrical signals representing the sound waves on path 134. Analog processing block 140 performs various analog processing operations on the electrical signals received on path 134, such as filtering, amplification etc, and provides processed audio signals (in analog form) on path 146.

ADC 160 samples the analog audio signals on path 146 at corresponding time instances, and generates corresponding digital codes. ADC 170 forwards the digital codes representing sound 131 on path 168. Optics and image sensor block 110, audio replay block 120, microphone 130, analog processing blocks 140 and 150, and ADCs 160 and 170 may be implemented in a known way.

Storage 190, which may be implemented as any type of memory, may store raw (unprocessed) or processed (digitally by digital processing block 180) audio and image data, for streaming (real time reproduction/replay) or for replay at a future time. Storage 190 may also provide temporary storage required during processing of audio and image data (digital codes) by digital processing block 180.

Specifically, storage 190 may contain units such as a hard drive, removable storage drive, read-only memory (ROM, random access memory (RAM) etc. Storage 190 may store the software instructions (to be executed on digital processing block 180) and data, which enable camera 100 to provide several features in accordance with the present invention.

Some or all of the data and instructions may be provided on storage 190, and the data and instructions may be read and provided to digital processing block 180. Any of the units (whether volatile or non-volatile, removable or not) within storage 190 from which digital processing block 180 reads such data/instructions, may be termed as a machine readable storage medium.

Audio replay block 120 may contain digital to analog converter, amplifier, speaker etc, and operates to replay an audio stream provided on path 182. The audio stream on path 182 may be provided incorporating ALC.

Digital processing block 180 receives digital codes representing scene 101 on path 178, and performs various digital processing operations (image processing) on the codes, such as edge detection, brightness/contrast enhancement, image smoothing, noise filtering etc.

Digital processing block 180 receives digital codes representing sound 131 on path 168, and performs various digital processing operations on the codes, including automatic level control of speech signals contained in the codes. Digital processing block 180 may apply corresponding gain factors as determined by the ALC approach either to the digital samples (within digital processing block 180) or to either or both of analog processing block 140 and/or ADC 160 via path 184. Digital processing block may be implemented as a general purpose processor, application-specific integrated circuit (ASIC), digital signal processor, etc.

A brief conceptual description of automatic level control (ALC) of speech signals is provided next with respect to an example waveform. Though ALC is described below with respect to digital processing block 180, it should be appreciated that the features of the present invention can be implemented in other systems/environments, using other techniques, without departing from several aspects of the present invention, as will be apparent to one skilled in the relevant arts by reading the disclosure provided herein.

3. Audio Signal

Figure 2:
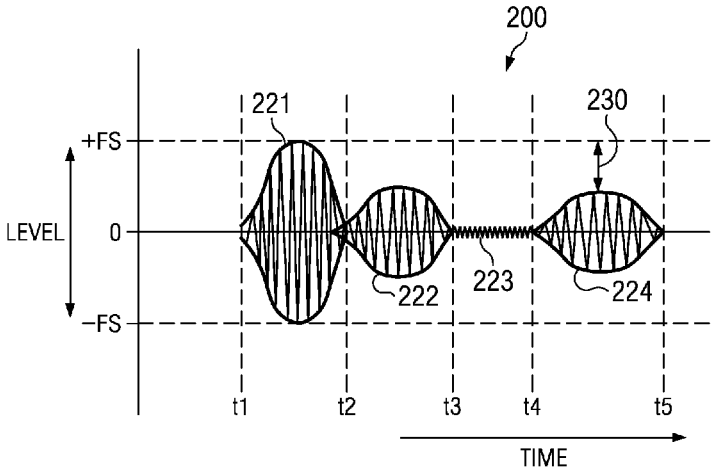
FIG. 2 is a diagram used to illustrate automatic level control of a speech signal.

FIG. 2 is a diagram used to illustrate automatic level control of a speech signal. The diagram is shown containing an audio (sound) signal 200. For simplicity, sound signal 200 is shown as a continuous waveform. However, it must be understood that sound signal also represents digital codes as may be provided on path 168 (FIG. 1). In FIG. 2, time is indicated along the x-axis, while level/amplitude is indicated along the y-axis. +FS and −FS denote respectively the desired positive and negative full-scale level of the audio signal, after the automatic level control.

Portion 221 of audio signal 200 contained between time instances t1 and t2 is shown as having a peak level (amplitude) equal to the full-scale level. Portions 222, 223 and 224 are shown as having peak amplitudes less than the full-scale level. With respect to audio signal 200, portions 221, 222 and 224 may represent speech, while portion 223 may represent non-speech/noise.

It may be desirable to control the level/amplitude of speech portions in audio signal 200 such that the range +FS and −FS is adequately used in representing the speech portions (or generally, utterances noted in the background section). Thus, with respect to FIG. 2, no gain need be applied to portion 221, while a gain to raise the peak value of portion 224 determined by a level 230 may need to be applied.

Similarly, assuming portion 223 represents non-speech/noise, no gain needs to be applied this portion. Alternatively, it may be desirable to provide attenuation for portions identified as noise.

It should be appreciated that the gain requirements of above are to be performed without changing the relative amplitude characteristics at a micro level such that the nature of the audio signal is still preserved. For example, it is noted here that there may be substantial variations (as may be observed from FIG. 2) in the instantaneous signals levels of a speech portion. Such relative variations at micro-level are inherent in the speech signal itself, and may need to be preserved.

Several aspects of the present invention provide ALC of speech signals, and are illustrated next with respect to a flowchart.

4. Automatic Level Control of Speech Signals

Figure 3:
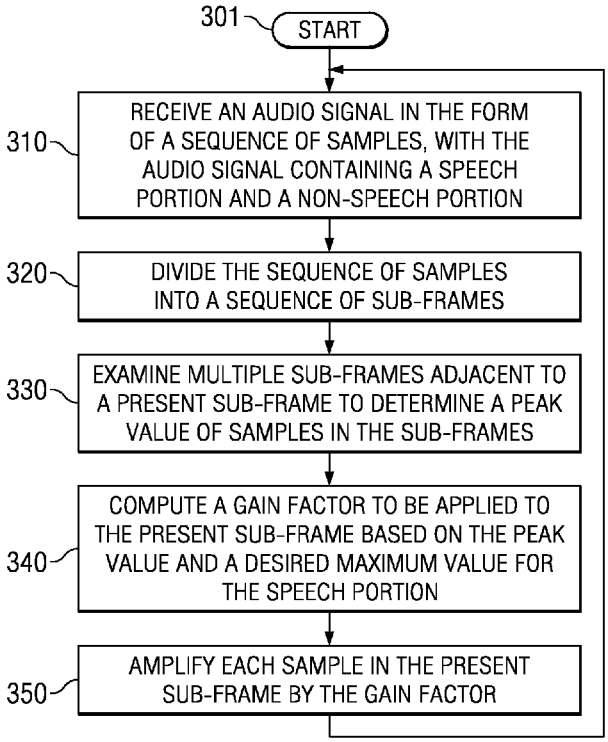
FIG. 3 is a flowchart illustrating the manner in which ALC of speech signals is provided in an embodiment of the present invention.

FIG. 3 is a flowchart illustrating the manner in which ALC of speech signals is provided in an embodiment of the present invention. The flowchart is described with respect to FIGS. 1 and 2 merely for illustration. However, various features described herein can be implemented in other environments, as will be apparent to one skilled in the relevant arts by reading the disclosure provided herein. The flowchart starts in step 301 in which control is transferred to step 310.

In step 310, digital processing block 180 receives an audio signal in the form of a sequence of samples, with the audio signal containing a speech portion (e.g., portions 221/224 of FIG. 2) and a non-speech portion (e.g., 223). The sequence of samples may be generated by a corresponding ADC, for example ADC 160 (FIG. 1). Control then passes to step 320.

In step 320, digital processing block 180 divides the sequence of samples into a sequence of sub-frames. The size/duration of each sub-frame needs to be sufficiently small such that sufficient control is available in amplifying each portion. At the same time, the duration needs to be large enough such that the speech characteristics are not altered within a speech segment. In an embodiment, each sub-frame equals (or contains) successive samples corresponding to 20 milli-seconds duration. Though the sub-frames are described as being non-overlapping (in terms of time or samples), alternative embodiments can be implemented with overlapping sub-frames, as suited for the specific environment. Control then passes to step 330.

In step 330, digital processing block 180 examines multiple sub-frames adjacent to a present sub-frame to determine a peak value (absolute value, disregarding sign) of samples in the sub-frames. While the example embodiments of below are described with reference to a frame containing only a fixed number of prior sub-frames for each present sub-frame, alternative embodiments can be implemented to use varying number of sub-frames, as well as even later received sub-frames (with appropriate buffering structure). Control then passes to step 340.

In step 340, digital processing block 180 computes a gain factor to be applied to the present sub-frame based on the peak value and a desired maximum value for the speech portion. The desired maximum value may be determined a priori and equals +FS/−FS in the illustration of FIG. 2. It should be further appreciated that the peak value of the present sub-frame may be used in combination with the peak values of other sub-frames in determining the gain factor using one of various approaches, as will be apparent to one skilled in the relevant arts. Control then passes to step 350.

In step 350, digital processing block 180 may amplify each sample in the present sub-frame by the gain factor. Control then passes to step 310, in which another sequence of samples is received, and the steps of the flowchart may be repeated.

It should be appreciated that the features described above can be realized in various embodiments. In an embodiment described below, digital processing block 180 divides received (audio) samples into frames, which in turn contains the sub-frames noted above. Accordingly, the description is continued with an illustration of the manner in which sub-frames are operated upon.

5. Frames

Figure 4:
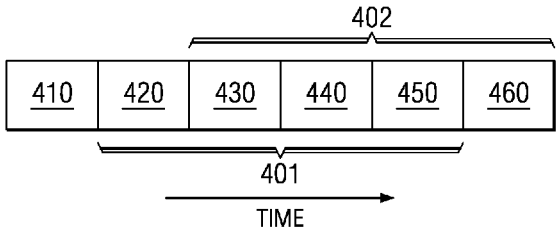
FIG. 4 is a diagram illustrating the manner in which a frame contains multiple sub-frames in an embodiment.

FIG. 4 is a diagram used to illustrate the manner in which digital processing block 180 operates on audio samples. As noted above, in an embodiment digital processing block 180 divides received audio samples into a sequence of sub-frames. These sub-frames are in turn grouped as frames. In general, each frame needs to contain sufficient sub-frames such that the speech and non-speech components can be reasonably detected based on historic (in general, adjacent) information.

In FIG. 4, 410-460 represent an example sequence of sub-frames formed by digital processing block 180, with each sub-frame containing multiple samples (digital codes representing an audio signal). Sub-frame 410 is the earliest sub-frame received/formed, while 460 is the latest sub-frame received/formed. In the embodiment, a set successive sub-frames is termed a frame. As an illustration, the set of successive sub-frames 420-450 may be viewed as frame 401, the set of successive sub-frames 430-460 may be viewed as (a next) frame 402 etc.

As described in detail below, digital processing block 180 may determine a peak level for a currently received sub-frame based on corresponding peak sample values determined for previous sub-frames. Thus, for example, assuming sub-frame 450 is the currently formed (or present) sub-frame, digital processing block 180 may determine a peak corresponding to sub-frame 450 by determining a peak within sub-frame 450 as well as peaks determined earlier for past sub-frames 420-450.

Similarly, digital processing block 180 may determine a peak for a 'next' present sub-frame 460 based on a peak determined within sub-frame 460 as well as those determined for earlier sub-frames. Thus, in the embodiment, digital processing block 180 determines peak values of a moving "window" of frames, each containing different sub-frames. The number of sub-frames considered for each present frame is fixed such that the window of sub-frames considered for computing the gain factor moves for each successive present frame.

The description is continued with details of a digital processing block in an embodiment.

6. Digital Processing Block

Figure 5:
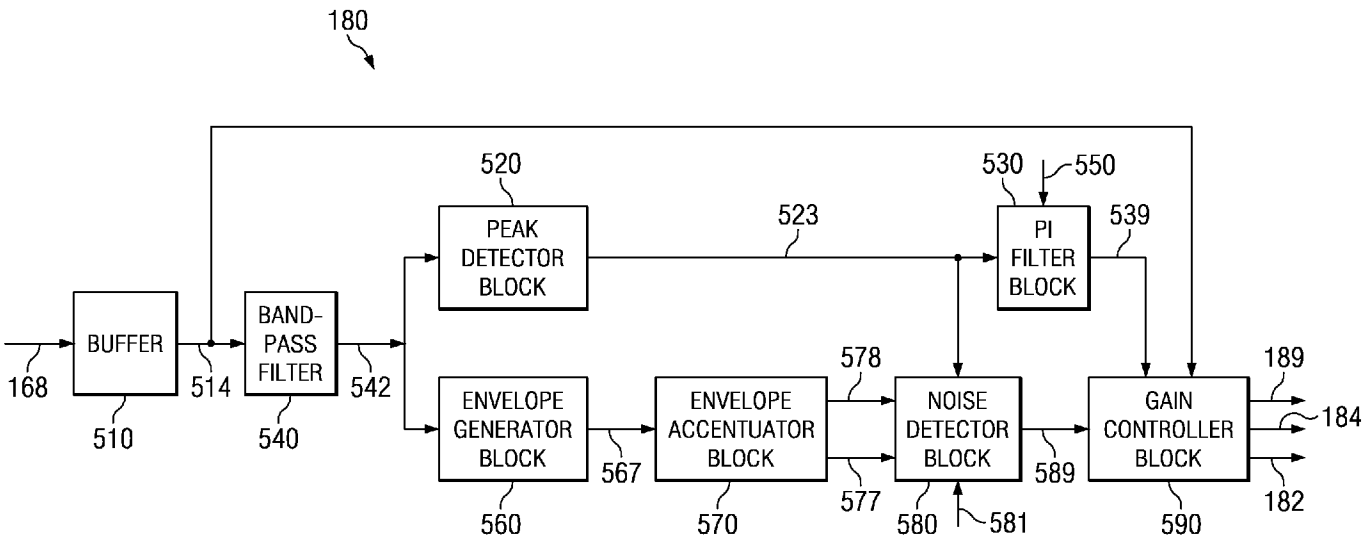
FIG. 5 is a block diagram illustrating the various operational blocks in a digital processing block providing ALC of speech signals in an embodiment of the present invention implemented substantially in software

FIG. 5 is a block diagram illustrating the various operational blocks in a digital processing block providing ALC of speech signals in an embodiment of the present invention. Digital processing block 180 is shown containing buffer 510, peak detector block 520, proportional integral (PI) filter block 530, band-pass filter 540, envelope generator block 560, envelope accentuator block 570, noise detector block 580, and gain controller block 590. Though not shown, a control block may coordinate and control the operations of the blocks of FIG. 5 such that the processing is consistent with the frame/sub-frame boundaries, as needed in the specific context.

In an embodiment, the control block is implemented to select 20 milliseconds (ms) as the duration of a sub-frame, and 200 ms as the duration of a frame. In general, the sub-frame duration may be selected such that a sub-frame contains a syllable or a word of speech (typically). The frame duration may be selected such that a frame contains a spoken segment, for example, a sentence or multiple words of speech.

It must be understood that the blocks are shown as separate merely for the sake of illustration and the operations of two or more blocks may also be combined in a single block. In addition, each of the blocks may be implemented in a desired combination of hardware, software and firmware (e.g., as FPGAs, ASICs, or software instructions alone), as suited for the specific environment.

As will be appreciated from the description below, peak detector block 520 and PI filter block 530 together operate to provide a measure indicating how much gain needs to be applied for each sub-frame. Envelope generator block 560, envelope accentuator block 570 and noise detector block 580 together operate to identify portions (the specific sub-frames) of a speech signal that represent speech portions and non-speech/noise portions. Each block is described in detail below.

Buffer 510 is a memory that receives audio samples (digital codes) corresponding to an audio signal on path 168. Buffer 510 may be implemented to internally contain multiple memory units such that, while the samples in one filled memory unit are forwarded on path 514 for processing, one or more other memory units may receive new samples.

In general, the buffer needs to have the ability to provide all the samples required by the subsequent blocks in the processing path. In an embodiment, buffer 510 in implemented to have a size to store 160 samples, with the samples being generated at 8 KHz sampling rate. Buffer 510 forwards samples on path 514 to band-pass filter 540 (for example, in the same chronological order in which the samples were received on path 168).

Band-pass filter 540 performs band-pass filtering on the samples received on path 514 to limit the energy outside the frequency band (speech) of interest. In an embodiment, band-pass filter 540 is implemented to have a pass band of frequencies in the range 120 Hz to 3600 Hz. Band-pass filter 540 forwards the filtered samples on path 542 to peak detector block 520 as well as envelope generator block 560.

Peak detector block 520 receives filtered samples on path 542, and determines the peak corresponding to each present sub-frame (sub-frame presently being processed) based on previously received sub-frames of the current frame, in manner described above with respect to FIG. 4. It should be understood that each sub-frame may be processed by different blocks in different time durations, but is referred to as a present sub-frame, merely to refer to the same frame. The term 'present frame' is also similarly used, which may be viewed as a sliding window in the described embodiment(s).

The peak level may be determined as the absolute value of positive or negative peak in the samples. In general, peak detector block 520 may be viewed as generating a peak value corresponding to each sub-frame, with the number of sub-frames considered in such peak computation being fixed (for example, four in FIG. 4). Peak detector block forwards the determined peak value (of all the samples in the current frame) corresponding to presently processed sub-frame on path 523.

PI filter block 530 computes for each sub-frame an error signal indicating the difference between a desired maximum level (target level) provided on path 550 (example +FS/−FS noted above with respect to FIG. 2) and a peak level corresponding to each sub-frame. PI filter block 530 filters the error signal by passing the error signal through a proportional-integration (PI) filter to smooth variations (e.g., high frequency/sudden changes) in the error values. It may be appreciated that the filtered error values output by PI filter block 530 may be used as one of the factors for computing a gain factor for each sub-frame. PI filter block 530 forwards the filtered error values to noise detector block 580 on path 539.

Envelope generator block 560 receives samples/sub-frames on path 542, and generates a parameter representative of the "energy" contained in each sub-frame portion. In an embodiment, envelope generator block 560 computes the average of the squared values of each sample in a sub-frame as an estimate of the energy. However, any other measure (for example, cubed values) representative of energy may also be used. Envelope generator block 560 forwards the energy (envelope value) computed for each sub-frame on path 567. The energy value across sub-frames of the signal may be viewed as forming an envelope of the signal with one sample per sub-frame.

Envelope accentuator block 570 applies another proportional-integration (PI) filter to filter the energy values received on path 567 for amplifying the variation of energy across sub-frames. Thus, envelope accentuator block 570 generates a pseudo-envelope of energy of the audio signal. The operation of envelope accentuator block 570 serves to accentuate the energy of the different portions (e.g., a set sub-frames) of the audio signal 168, and thereby enable a better discrimination of speech and non-speech portions in noise detector block 580 (described below). Envelope accentuator block 570 forwards the filtered energy values on path 578. Envelope accentuator block 570 may also forward the noise level of corresponding sub-frames on path 577.

Noise detector block 580 receives the filtered energy values on path 578 and operates to determine which sub-frames (or successive sets of sub-frames) correspond to speech and non-speech portion. Noise detector block 580 may compute a variation in the filtered energy values across multiple sub-frames, and conclude that the sub-frames represent a speech portion if the variation exceeds a pre-determined threshold, and represent non-speech portions otherwise.

In an embodiment, the number of sub-frames across which such variation is observed by noise detector block 580 is based on the frame size, i.e., the variation is observed across all sub-frames in a frame. With respect to the example sub-frame/frame sizes noted above, the variation is observed in one embodiment across ten sub-frames (200 ms/20 ms). Thus, if the signal does not show significant energy factor variation in a present frame, the present sub-frame is classified as noise. The energy factor threshold is 0.0008 when the amplitude of the signal varies between +/−1.0. However, in alternative embodiments, different thresholds, fewer or more sub-frames than contained in a frame may also be used.

Alternatively, noise detector block 580 may base the decision of whether a sub-frame represents a speech/non-speech portion on a comparison of a peak value (received via path 523) corresponding to the sub-frame and a noise floor value (representing the typical noise floor based on the operating conditions, components such as ADC employed etc.) received on path 581. If the peak value is greater than the noise floor, noise detector block 580 may conclude that the sub-frame corresponds to a speech portion.

If the peak value is less than the noise floor, noise detector block 580 may conclude that the sub-frame corresponds to a non-speech portion. Noise detector block 580 may be implemented such that the basis for a speech/non-speech decision is made programmable between the two options noted above, or a combination of both. Noise detector block 580 provides on path 589 a binary number (bit) specifying whether a sub-frame corresponds to a speech or a non-speech portion.

Gain controller block 590 receives sub-frames on path 514, filtered error values on path 539, and binary decisions specifying whether a presently received sub-frame corresponds to speech portion or non-speech portion on path 589. Based on the received inputs noted above, gain controller block 590 computes and applies a gain factor to the presently received sub-frame either within digital processing block 180 itself, or via path 184 to the corresponding portion of the analog signal in either analog processing block 140 and/or ADC 160.

Assuming the received input on path 589 specifies that the present sub-frame is in a speech portion, gain controller block 590 applies a gain based on the desired amplitude (+FS/−FS noted above) and the filtered peak values. In an embodiment, the gain factor is computed as shown in Equation (1) below, though various alternative approaches can be used without departing from the scope and spirit of several aspects of the present invention, as will be apparent to one skilled in the relevant arts:

$$\text{Gain factor}=\text{desired amplitude}/\text{filtered peak amplitude} \qquad \text{Equation 1}$$

Gain controller block 590 may store the processed (ALC implemented) audio samples in storage 190 (FIG. 1) via path 189. Gain controller 590 may also (under user control) forward the processed audio samples for replay via path 182. Gain controller block 590 may additionally operate to amplify/attenuate corresponding speech/non-speech portions based on other considerations as well, as described below.

The specific mathematical formulas/considerations based on which the various blocks described above compute their corresponding outputs in an example embodiment are described next.

7. Mathematical Analysis

The following section describes the mathematical operations/pseudo code as well as other considerations based on which each block of digital processing block 180 determines a corresponding output in an embodiment of the present invention.

Peak Detector Block 520:

Pseudo code of peak signal level detection logic is given below, wherein xpk[k] is a peak value corresponding to a present sub-frame:

Initialize xpk[k] to 0:

$$xpk[k]=0 \qquad \text{Equation 2}$$

For each sample within sub-frame:

If xpk_sf[k]>x[n]

$$xpk_sf[k]=xpk_sf[k] \qquad \text{Equation 3}$$

else if xpk_sf[k]≦x[n]

$$xpk_sf[k]=x[n] \qquad \text{Equation 4}$$

End If

End For

In the pseudo-code above:

k is an index of sub-frames with range [0 . . . K], n is the index of audio samples in a sub-frame, with range [0 . . . K], xpk_sf[k] is the peak sample in a current frame, For each sub-frame within frame $$xpk_f = \mathrm{MAX}(xpk_sf[k]) \quad \text{Equation 5}$$

End For

Wherein, k=0, 1, 2, . . . , K, xpk_f (also denoted as xpk[k] below) is the max amplitude sample in current frame.

The peak signal xpk_f (equation 5) is provided on path 523

PI Filter Block 530:

PI filter block 530 computes an error value/signal by subtracting the peak signal from a desired level (or a maximum allowed signal level). The error value is passed through a PIcontroller to produce smoothened error signal err[k], as expressed by the following equation:

$$x^{pk}_{PI}[k] = x^{pk}_{PI}[k-1] + I*xpk[k]$$

$$\mathrm{err}[k] = x^{pk}_{target} - x^{pk}_{PI}[k] \quad \text{Equation 8}$$

wherein, err[k] is the filtered error signal corresponding the current sub-frame k, $x^{pk}_{PI}[k]$ is the filtered peak of the current sub-frame $x^{pk}_{target}$ is the target level (desired level)

xpk[k] is the peak value for the current sub-frame and equals xpk_f of equation 5, I is the integral coefficient of the PI controller, and may be selected based on whether err[k−1] is above or below the error ($x^{pk}_{target}$−xpk[k]). In an embodiment, if err[k−1] is below such error, I=+0.050. If above, I=−0.080. If xpk[k] is above $x^{pk}_{target}$, then I=−0.3 to avoid possible clipping after gain control.

err[k] is provided is provided on path 567.

Envelope Generator Block 560:

Pseudo code for computing the energy (proportional to square of xmean[k]) is provided below:

For each sample within sub-frame $$xmean[k] = \sqrt{\frac{1}{N}\sum_{n=0}^{n=N} x^2[n]} \quad \text{Equation 9}$$

End For

Wherein, xmean[k] is mean amplitude in current sub-frame k, x[n] is the nth sample within current sub-frame k.

xmean[k] is forwarded on path 567.

Envelope Accentuator Block 570:

The envelope accentuator can be implemented based on the below logic (in any combination of hardware, software and firmware):

```
//!< if raise noise floor
if( xmean[k] > estNoiseLt[k−1] )
{
    // AmplifyFactor1dB = 1.0 / 0.8913
    estNoiseLt[k]    = estNoiseLt[k−1] * AmplifyFactor1dB;
    //!< Saturate the estimated noise floor limit with mean signal
```

-continued

```
        level if(estNoiseLt[k] > xmean[k]) {
            estNoiseLt[k] = xmean[k];
        //!< if estNoiseLt[k] is too small or zero and xmean[k] is
        non-zero
        } else if( (estNoiseLt[k] == 0) && (xmean[k] != 0) ) {
            //!< use optimal noise floor        (0.0008)
            estNoiseLt[k] = optNoiseFloorConst;
        }
        // PI aided increase of noise floor (P=+0.1, I=+0.1)
        env[k] = env[k−1]*I + estNoiseLt[k]*P;
    }
    //!< if noise floor to be lowered
    else if(xmean[k] < estNoiseLt[k−1])
    {
        // AttenuateFactor1dB = 0.8913
        estNoiseLt[k]    = estNoiseLt[k−1] * AttenuateFactor1dB;
        //!< Don't allow the noise floor limit to go below mean signal
        level if(estNoiseLt[k] < xmean[k]) {
            estNoiseLt[k] = xmean[k];
        //!< if estNoiseLt[k] is too small or zero and xmean[k] is
        non-zero
        } else if( (estNoiseLt[k] == 0) && (xmean[k] != 0) ) {
            //!< use optimal noise floor        (0.0008)
            estNoiseLt[k] = optNoiseFloorConst;
        }
        // PI aided decrease of noise floor (P=−0.1, I=+0.2)
        env[k] = env[k−1]*I + estNoiseLt[k]*P;
        if( env[k] < 0) {
            //!< prevent negative
            env[k] = 0;
        }
    }
    //!< if noise floor level to be maintained
    else
    {
        estNoiseLt[k] = estNoiseLt[k−1];
    }
    env[k] = env[k−1];
//!< update state estNoiseLt[k−1]
    if( estNoiseLt[k−1] != estNoiseLt[k] ) {
        estNoiseLt[k−1] = estNoiseLt[k];
    } else {
        //!< Try to bias towards lowering of noise floor by 1 dB
        //!< Introduce error to keep the PI loop running
    estNoiseLt[k−1] = 1.121*estNoiseLt[k];
    }
```

As noted above, envelope accentuator block 570 operates to highlight/accentuate the energy in the various portions of an audio signal (by generating a pseudo-envelope or accentuated/amplified envelope), thereby enabling better discrimination in determining such portions. The mean value xmean [k] is passed through to PI filter block 530 filter to generate an envelope in a manner expressed by the following equation:

$$env[k] = env[k-1]*I + estNoiseLt[k]*P; \quad \text{Equation 10}$$

Wherein, where P and I are proportional and integral coefficients respectively, env[k] is the pseudo-envelope of signal energy (energy variations are amplified) computed for the present sub-frame k, estNoiseLt [k] is the envelope (filtered noise floor value) computed (within envelope accentuator block 570) for the current sub-frame (k).

env[k] is forwarded on path 578.

Dither may be added when necessary to prevent PI controller in envelope accentuator block 570 from settling down to a steady state.

Noise Detector Block 580:

As noted above, noise detector block 580 determines if a current sub-frame corresponds to a speech portion or a non-speech portion based on multiple filtered energy values (env [k], env[k−1] . . . env[k−m]), m representing the total number of sub-frames across which variations in energy values is considered. As noted above, in an embodiment, noise detector block 580 bases such decision on ten sub-frames.

If variation in pseudo envelope values across the ten sub-frames exceeds 0.0008 (assuming total input signal amplitude varies between −1 and +1 units), the subframe is detected as speech. In case of speech portion to non-speech portion transition, the detection of the non-speech portion is checked for consistency (as being non-speech) for twenty sub-frames (i.e., twenty consecutive sub-frames need to be declared as noise). On startup (commencement of the ALC operation), the signal is assumed to be noise.

As an alternative technique, noise detector block 580 may make the speech/non-speech portion decision based on peak value xpk given by equation 5, and the noise floor value received on path 581, as described above. In an embodiment, the noise floor value received on path 581 is 0.1 (again assuming peak-to-peak signal variation of −1 to +1 units). Alternatively, the noise floor value estNoiseIt[k] (equation 10) may be used instead of the value from path 581. As noted above, the value of estNoiseIt[k] is provided by envelope accentuator block 570 to noise detector block 580 via path 577.

Gain Controller Block 590:

Gain controller block 590 applies a gain factor in manner described above. In addition the manner in which the gain factor is applied may also be based on other considerations, such as whether the present sub-frame has been determined to be the first (earliest) sub-frame in a speech portion or a non-speech portion, whether it is desired to attenuate noise portions or merely not apply any gain, etc. Some of the considerations are noted below.

If a present sub-frame is classified as noise/non-speech, amplification (gain factor) is reduced gradually (rather than abruptly) to reach 0 dB.

If continuous frames are observed to be noise, the signal is attenuated gradually to reach desired level of attenuation.

On speech signal detection (i.e., first sub-frame in a speech portion), any attenuation earlier applied/present is removed gradually. In case of rapid change of signal energy in speech segment of the signal, the gain is reduced gradually to avoid signal clipping (saturation). The rate of change of gain can be controlled to be faster or slower by means of gain scaling factors, depending on the cause and nature of gain change. If the rate of gain change is too fast, audible zipper noise and noise energy fluctuation can result in deteriorated sound quality. If the gain change is too slow, noise amplification and clipping can cause audible noise. Thus, optimal rate of gain change should be selected based on cause for gain change.

For speech portions, the goal of gain change is to make err[k] (equation 8) approach zero. The difference between desired (or maximum allowed) signal level and err[k] provides the basis for gain factor computation, as noted above.

In an embodiment, the gain controller increases the gain at the rate of 1 decibel (db) per sub-frame, and decreases the gain by 2 dB per sub-frame. The gain change value are programmable. In an embodiment, on detection of a continuous non-speech portion over an observation window, the non-speech segment is attenuated with a specifiable value (−6 dB in the embodiment). On non-speech to speech portion transition, a faster gain increase (2 dB per sub-frame) may be used till all attenuation is removed.

It may be appreciated that gain can be applied either on digital data (i.e., within digital processing block 180) or to the analog signal itself (for example, in analog processing block 140 or in ADC 160 of FIG. 1), such selection being enabled by a user via a user input not shown. In general, gain may be applied to the analog signal in ADC 160 provided headroom is available in digital domain (i.e., digital processing block 180) for the corresponding digital samples. Such headroom may be needed to detect clipping caused by analog gain and naturally peaking input signal. In case of clipping caused by ALC, the gain needs to be lowered (If application of gain value is larger than required, the signal will be clipped on digital domain. In order to remove clipping and thus restore the sound quality to original, the gain needs to be reduced).

If analog gain is chosen to be applied, delay in such application is taken into account to ensure the gain factor computed is applied to the correct sub-frame (in analog form in ADC 160/analog processing block 140). Such delay may be determined by estimating the total delay in the path from analog processing block 160/ADC 180, and the processing delay within digital processing block 180.

When gain is applied digitally on the samples within digital processing block 180 fixed point multiplication of the samples by the corresponding gain factor may be used when low computational complexity/delay is desired. Alternatively, floating point multiplication may be used when computational complexity can be tolerated.

The operation of ALC described above is illustrated next with respect to example waveforms.

8. Illustrative Example

Figure 6:
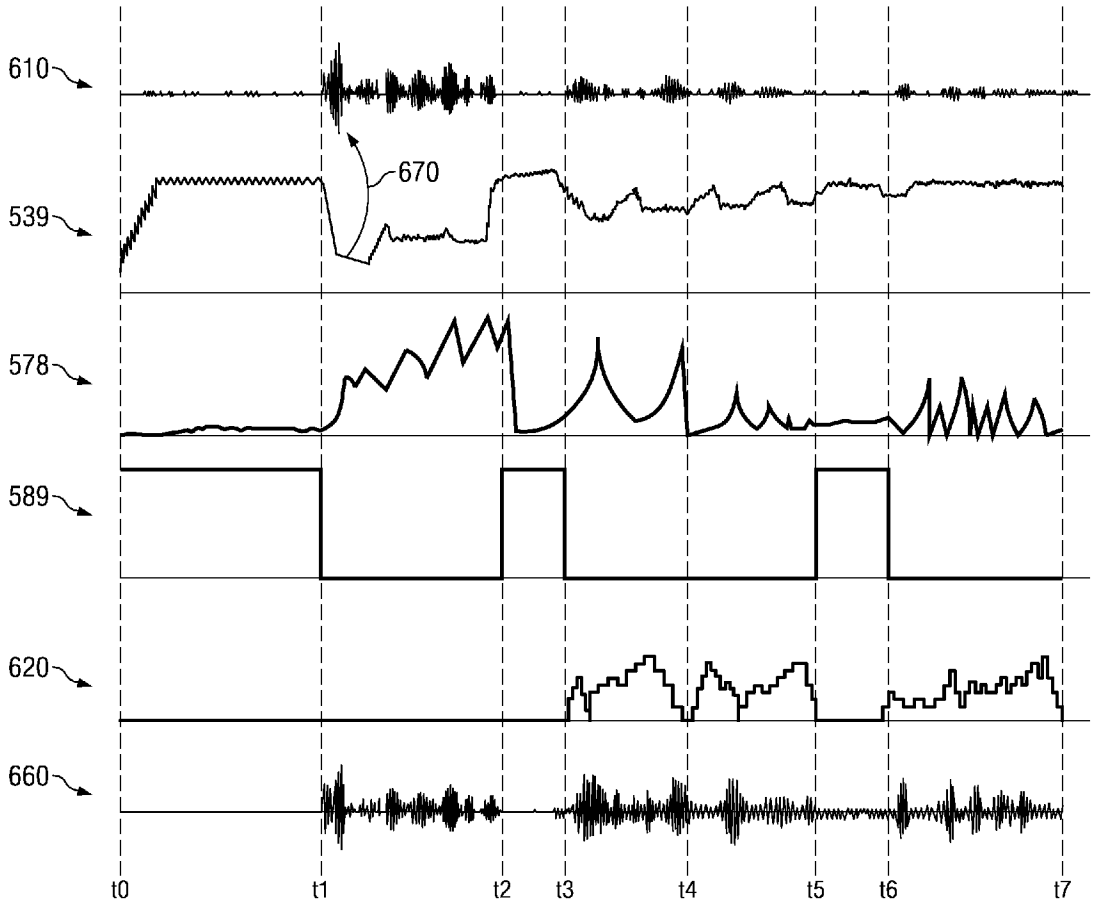
FIG. 6 is a diagram illustrating various example waveforms at the outputs of corresponding blocks of a digital processing block operating to provide ALC.

FIG. 6 is a diagram illustrating various example waveforms at the outputs of corresponding blocks of a digital processing block operating to provide ALC in an embodiment. It must be understood that the waveforms are shown merely to illustrate the concepts and operations of the various blocks of digital processing block 180 described above, and may not be precise representations of corresponding waveforms in actual operation.

In FIG. 6, waveform 610 may represent input analog audio signal 131, the signal on paths 134/146, or the digitized samples on paths 168 of FIG. 1 or path 512 (FIG. 5). Waveform 539 represents the output of PI filter block 530 corresponding to waveform 610. Waveform 578 represents the output of envelope accentuator block 570 corresponding to waveform 610. Waveform 589 represents the output of noise detector block 580. Waveform 620 represents the gain factor (gain) applied by gain controller block internally to the corresponding sub-frame, or provided as output 184. Waveform 660 represents an audio signal 610 with ALC incorporated. The example waveforms are described briefly below.

It may be observed from waveform 610 that portions in time intervals t0-t1, t2-t3 and t4-t5 correspond to noise/non-speech portions, while portions in time intervals t1-t2, t3-t4, t4-t5 and t6-t7 correspond to speech portions. Accordingly, it may be observed that filtered error signal 539 has a large value in the non-speech portions, signifying that peak detector block 520 and PI filter block 530 have determined that peaks in such portions are very low. On the other hand, filtered error signal 539 has lower values in speech portions. As a specific illustration, arrow 670 shows a small value of filtered error corresponding to the large signal level in the corresponding point of waveform 610.

Filtered energy values 578 have small values in noise portions and larger values in speech portions. Specifically, the variations in filtered energy values 578 may be observed to be large in speech portions, and smaller in non-speech portions. For filtered energy values 578 in the interval t0-t1 are relatively small (almost zero) and also flat (very little variation), thereby indicating that the portion corresponds to a non-speech portion. On the other hand, filtered energy values 578 in the interval t1-t2 have larger values, and more significantly exhibit more variation, thereby indicating that the portion corresponds to speech portion. Portions of signal 539 and 579 for the other time intervals shown in the Figure also have corresponding properties, as noted above.

Waveform 589 accordingly provided as a binary output (with binary 1 indicating a non-speech portion, and a binary 0 indicating a speech portion) specifies the respective speech and non-speech portions. Gain 620 is shown as being low (or zero) for the portions which are non-speech, as well as for speech portions which have significant amplitudes (e.g., in time interval t1-t2). Corresponding gain values applied for portions identified as speech in the intervals t3-t4, t4-t5 and t6-t7 cause the corresponding speech portions to be amplified as may be observed by a comparison of the corresponding signal portions in waveforms 610 and 760.

Thus, several aspects of the present invention operate to provide ALC of a speech signal. While in the foregoing description ALC is described as being provided by a digital processing block using software instructions, it will be apparent to one skilled in the relevant arts by reading the disclosure herein that various other approaches such as hardware, firmware, combination of hardware/firmware/software using corresponding components may also be used to provide the features.

9. Conclusion

While various embodiments of the present invention have been described above, it should be understood that they have been presented by way of example only, and not limitation. Thus, the breadth and scope of the present invention should not be limited by any of the above-described embodiments, but should be defined only in accordance with the following claims and their equivalents.

What is claimed is:

1. A method of processing audio signals, said method comprising:

receiving an audio signal in the form of a sequence of time samples, said audio signal containing a speech portion and a non-speech portion;

dividing said sequence of time samples into a sequence of time sub-frames;

examining a plurality of sub-frames adjacent to a present sub-frame to determine a peak value of samples in said plurality of sub-frames;

computing a gain factor to be applied to said present sub-frame based on said peak value and a desired maximum value for said speech portion; and amplifying each sample in said present sub-frame by said gain factor;

determining whether said present sub-frame is a part of said speech portion or of said non-speech portion, wherein said amplifying is performed on said present sub-frame only if said present sub-frame is determined to be part of said speech portion.

2. The method of claim 1, wherein said determining comprises:

computing a sequence of energy values, with each value representing the energy of the audio signal in the corresponding one of said sequence of sub-frames forming an envelope of said audio signal by magnifying the high frequency changes in said sequence of energy values thereby forming filtered energy values;

computing a variation in said filtered energy values across multiple sub-frames; and concluding that said present sub-frame is said speech portion if said envelope corresponding to said sub-frame contains a number of said variations in said filtered energy values greater than a threshold and that said present sub-frame is said non-speech portion if said number of variations are below said threshold.

3. The method of claim 2, wherein said determining further comprises:

concluding that said present sub-frame is said non-speech portion if the peak value corresponding to the present sub-frame is below a pre-determined threshold, even if said envelope corresponding to said sub-frame contains said number of variations in said filtered energy values greater than said threshold.

4. The method of claim 2, wherein said method further comprises:

forming a respective frame corresponding to each of said sequence of sub-frames viewed as a present sub-frame, said respective frame containing a corresponding plurality of adjacent sub-frames which are adjacent to the corresponding present frame, wherein said computing computes a sequence of peak values, with each peak value corresponding to a specific one of the plurality of adjacent sub-frames, wherein said computing computes said gain factor for each sub-frame based only on said sequence of peak values of the corresponding plurality of adjacent frames.

5. The method of claim 4, wherein the corresponding plurality of adjacent sub-frames are all received before the present frame in said sequence of sub-frames.

6. The method of claim 5, wherein the number of adjacent frames for each present frame is fixed such that the window of sub-frames considered for computing the gain factor moves for each successive present frame.

7. The method of claim 6, wherein said computing comprises:

filtering said sequence of peak values to remove high frequency variations to generate a corresponding sequence of filtered values, wherein each filtered value corresponds to a corresponding one of said plurality of sub-frames; and calculating said gain factor for the present frame based on a difference of the corresponding filtered value and said desired maximum value.

8. The method of claim 7, further comprising passing said audio signal through a bandpass filter before said examining and said computing.

9. A machine readable medium storing one or more sequences of instructions for causing a device to process an audio signal, wherein execution of said one or more sequences of instructions by one or more processors contained in said system causes said system to perform the actions of:

receiving an audio signal in the form of a sequence of time samples, said audio signal containing a speech portion and a non-speech portion;

dividing said sequence of time samples into a sequence of time sub-frames;

examining a plurality of sub-frames adjacent to a present sub-frame to determine a peak value of samples in said plurality of sub-frames;

computing a gain factor to be applied to said present sub-frame based on said peak value and a desired maximum value for said speech portion; and amplifying each sample in said present sub-frame by said gain factor;

determining whether said present sub-frame is a part of said speech portion or of said non-speech portion, wherein said amplifying is performed on said present sub-frame only if said present sub-frame is determined to be part of said speech portion.

10. The machine readable medium of claim 9, wherein said determining comprises:

computing a sequence of energy values, with each value representing the energy of the audio signal in the corresponding one of said sequence of sub-frames;

forming an envelope of said audio signal by magnifying the high frequency changes in said sequence of energy values thereby forming filtered energy values;

computing a variation in said filtered energy values across multiple sub-frames; and concluding that said present sub-frame is said speech portion if said envelope corresponding to said sub-frame contains a number of said variations in said filtered energy values greater than a threshold and that said present sub-frame is said non-speech portion if said number of variations are below said threshold.

11. The machine readable medium of claim 10, wherein said computing comprises:

filtering said sequence of peak values to remove high frequency variations to generate a corresponding sequence of filtered values, wherein each filtered value corresponds to a corresponding one of said plurality of sub-frames; and calculating said gain factor for the present frame based on a difference of the corresponding filtered value and said desired maximum value.

12. An automatic level controller (ALC) circuit for processing audio signal, said ALC circuit comprising:

a buffer to receive an audio signal in the form of a time sequence of samples, said audio signal containing a speech portion and a non-speech portion, wherein said sequence of time samples are divided into a sequence of time sub-frames;

a peak detector block to examine a plurality of sub-frames adjacent to a present sub-frame to determine a peak value of samples in said plurality of sub-frames; and a gain controller block to compute a gain factor to be applied to said present sub-frame based on said peak value and a desired maximum value for said speech portion, and to amplify each sample in said present sub-frame by said gain factor;

a first circuit to determine whether said present sub-frame is a part of said speech portion or of said non-speech portion, wherein said gain controller is designed to amplify said present sub-frame only if said present sub-frame is determined to be part of said speech portion.

13. The ALC of claim 12, wherein first circuit comprises:

an envelope generator block to compute an envelope formed of a sequence of energy values, with each value representing the energy of the audio signal in the corresponding one of said sequence of sub-frames;

an envelope accentuating block to magnify the high frequency changes in said sequence of energy values thereby forming filtered energy values; and a noise detector block operable to compute a variation in said filtered energy values across multiple sub-frames, and conclude that said present sub-frame is said speech portion if said envelope corresponding to said sub-frame contains a number of variations in said filtered energy values greater than a threshold and that said present sub-frame is said non-speech portion if said number of variations are below said threshold.

14. The ALC of claim 13, wherein said noise detector block further operates to conclude that said present sub-frame is said non-speech portion if the peak value corresponding to the present sub-frame is below a pre-determined threshold, even if said envelope corresponding to said sub-frame contains said number of variations in said filtered energy values greater than said threshold.

15. The ALC of claim 13, wherein a respective frame is formed corresponding to each of said sequence of sub-frames viewed as a present sub-frame, said respective frame containing a corresponding plurality of adjacent sub-frames which are adjacent to the corresponding present frame, wherein said peak detector block is designed to compute a sequence of peak values, with each peak value corresponding to a specific one of the plurality of adjacent sub-frames, wherein said gain controller block is designed to compute said gain factor for each sub-frame based only on said sequence of peak values of the corresponding plurality of adjacent frames.

16. The ALC of claim 13, further comprises: a proportional integral (PI) filter block to filter said sequence of peak values to remove high frequency variations to generate a corresponding sequence of filtered values, wherein each filtered value corresponds to a corresponding one of said plurality of sub-frames, wherein said gain controller block is designed to calculate said gain factor for the present frame based on a difference of the corresponding filtered value and said desired maximum value.

17. A device comprising: an analog to digital converter (ADC) to generate a sequence of time samples from an audio signal containing a speech portion and a non-speech portion; and a processor operable to:

receive an audio signal in the form of a sequence of time samples, said audio signal containing a speech portion and a non-speech portion;

divide said sequence of time samples into a sequence of time sub-frames;

examine a plurality of sub-frames adjacent to a present sub-frame to determine a peak value of samples in said plurality of sub-frames compute a gain factor to be applied to said present sub-frame based on said peak value and a desired maximum value for said speech portion; and amplify each sample in said present sub-frame by said gain factor determine whether said present sub-frame is a part of said speech portion or of said non-speech portion, amplify said present sub-frame only if said present sub-frame is determined to be part of said speech portion.

* * * * *